US006055831A

United States Patent [19]

Barbe

[11] Patent Number: 6,055,831

[45] Date of Patent: May 2, 2000

[54] PRESSURE SENSOR CONTROL OF CHEMICAL DELIVERY SYSTEM

[76] Inventor: David J. Barbe, 108 Knight Dr., Winterville, N.C. 28590

[21] Appl. No.: 08/866,957

[22] Filed: May 31, 1997

[51] Int. Cl.[7] ..... D06F 39/02; D06F 39/08

[52] U.S. Cl. ..... 68/12.18; 68/17 R; 137/557; 137/566; 137/897; 222/55; 222/132; 222/135; 222/144.5; 222/145.5

[58] Field of Search ..... 68/12.18, 17 R, 68/207; 134/57 D, 99.2; 222/55, 63, 651, 255, 132, 135, 144.5, 145.5; 137/557, 566, 897

[56] References Cited

U.S. PATENT DOCUMENTS

| | | | |
|---|---|---|---|
| 3,333,259 | 7/1967 | Carothers, Jr. | 340/244 |
| 3,826,113 | 7/1974 | Noraas et al. | 68/12 R |
| 3,963,146 | 6/1976 | Esbjornsson | 222/59 |
| 4,142,539 | 3/1979 | Shih et al. | 134/113 |
| 4,691,850 | 9/1987 | Kirschmann et al. | 222/642 |
| 4,734,683 | 3/1988 | Bond, Jr. | 340/614 |
| 4,845,965 | 7/1989 | Copeland et al. | 68/17 R |
| 4,932,227 | 6/1990 | Hogrefe | 68/17 R |
| 4,941,596 | 7/1990 | Marty et al. | 222/144.5 |
| 4,964,185 | 10/1990 | Lehn | 8/158 |
| 5,014,211 | 5/1991 | Turner et al. | 364/478 |
| 5,059,954 | 10/1991 | Beldham et al. | 340/614 |
| 5,082,143 | 1/1992 | Schramm, Jr. | 222/66 |
| 5,246,026 | 9/1993 | Proudman | 137/3 |
| 5,390,385 | 2/1995 | Beldham | 8/158 |
| 5,392,618 | 2/1995 | Livingston et al. | 68/12.02 |
| 5,435,157 | 7/1995 | Laughlin | 68/17 R |
| 5,564,595 | 10/1996 | Minissian | 222/59 |
| 5,601,413 | 2/1997 | Langley et al. | 417/12 |

*Primary Examiner*—Philip R. Coe
*Attorney, Agent, or Firm*—Olive & Olive, P.A.

[57] ABSTRACT

A fluid delivery system transfers fluids from a set of containers each of which holds a different type fluid to a group of apparatus, such as washing machines, each of which requires that certain types of fluid be delivered to the apparatus in a certain sequence. The system operates under program control both with regard to sequence in which particular fluids are drawn from the containers and with regard to the apparatus to which the selected fluids are delivered. Fluid pressure in the fluid lines leading to the apparatus is sensed by pressure sensors located along these fluid lines in a manner enabling the operator of the system to immediately know which of several containers are empty.

3 Claims, 6 Drawing Sheets

PRESSURE SENSOR CONTROL OF CHEMICAL DELIVERY SYSTEM

BACKGROUND OF THE INVENTION

1. Field of the Invention

The invention relates generally to controlled dispensing of fluids and more specifically to controlled dispensing of fluids to a washing machine or the like.

2. Description of the Related Art

Chemical dispensers are commonly used in the commercial laundry industry to provide various chemicals to washing machines at the proper time in the cycle. Electrical signals from the washing machines (also later referred to as "washers") as provided in most washing machines are used to trigger delivery of alkalis, detergents, bleaches and other chemicals at particular points in the cycle to a particular machine. A number of problems confront commercial chemical delivery systems. First, the chemicals used are corrosive, viscous, and sometimes incompatible with one another. Controlling the exact amount of chemical dispensed, the order of chemical dispensing, and minimizing personnel and machine exposure to the concentrated liquids are all critical. Additionally, automated chemical delivery systems tend to minimize laundry personnel input in order to protect personnel and reduce human error. This practice, however, often results in empty chemical containers going unnoticed, which may cause a necessary chemical to be omitted from a wash cycle.

Various systems have been used in the past to overcome the problems referred to above. U.S. Pat. No. 4,964,185 teaches a system which uses solid chemicals that are sprayed with water to dissolve them. The system described in the '185 patent uses a feedback control system to compensate for the variable dissolving rate of such a solid and notifies the operator in the event of an outage of product. Water temperature, pressure and the condition of the solid product all impact the dissolving rate. The chemical delivery system disclosed in the '185 patent requires water temperature and pressure to be within limits that may not be available in every laundry. Not meeting these limit requirements would result in erratic and inaccurate delivery of chemical to the system washers. The system disclosed in the '185 patent also relies on electrical conductivity to determine the status of chemicals in the system. Therefore, electrically non-conductive chemicals cannot be monitored by this system.

Dispensers that strictly use liquid chemicals have been devised, such as described in U.S. Pat. No. 5,014,211. The '211 patent system uses liquid chemicals with individual peristaltic pumps to deliver chemicals to a single delivery conduit that distributes product. to various washers through valves and conductivity sensors. The '211 patent's reliance on conductivity sensors precludes complete monitoring of non-conductive chemicals.

U.S. Pat. No. 5,435,157 teaches the use of separate delivery conduits for incompatible chemicals in a dispenser that services two washers. While the '157 patent system solves some problems and minimizes costs compared to single washer dispensers, there is no feedback to control the concentration or quantity of solution delivered to washers.

U.S. Pat. No. 5,059,954 discloses a chemical delivery system which monitors the level of chemicals in chemical containers. This system, however, requires use of a sensing device for each chemical container, and does not provide a method for automatically priming the chemical pumps, in order to keep the wash loads consistent.

It is therefore the object of this invention to provide a pressure sensor for each washer and a computer system incorporating means to detect the status of chemicals in each chemical container.

It is a further object of this invention to provide an automatic system that automatically primes the pump prior to dispensing chemicals to a washer.

Is also an object of the present invention to provide a system that significantly reduces the number of chemical and water sensing components required for a chemical delivery system.

It is furthermore an object of the present invention to provide a system that may be used not only for washers but also in the field of chemical manufacturing, medicine, and retail beverage services.

SUMMARY OF THE INVENTION

The present invention is described in reference to washing machines and in this application employs one pressure sensor for each washer to determine if selected chemicals are being delivered from a plurality of upstream chemical containers according to pre-programmed formulas. The chemical delivery system uses a programmable computer system to monitor and control the delivery of chemicals and water to the washers. A transfer pump and pressure sensor, downstream of the transfer pump, are located along each washer input line. A particular pressure sensor detects the lack of chemical delivery when air bubbles in the washer input line to a specified washer causes the transfer pump to cavitate. Cavitation of the transfer pump causes a decrease in fluid flow in the washer input line between the transfer pump and the specified washer, thereby decreasing liquid pressure at the pressure sensor located along the particular washer input line. The pressure sensor transmits to the computer system the low fluid pressure signal. In response, the computer system stops chemical delivery and assumes that the chemical container delivering chemicals during the stop command is empty. If the pressure sensor senses high pressure in the washer input lint,, indicating that there is blockage between the sensor and the respective washer, the computer system will also stop chemical delivery. A programmable main program board is connected to an output display for display of system status. Membrane switches allow an operator the scroll through the display's system status messages.

DETAILED DESCRIPTION OF THE INVENTION AND PREFERRED EMBODIMENTS THEREOF

Figure 1:
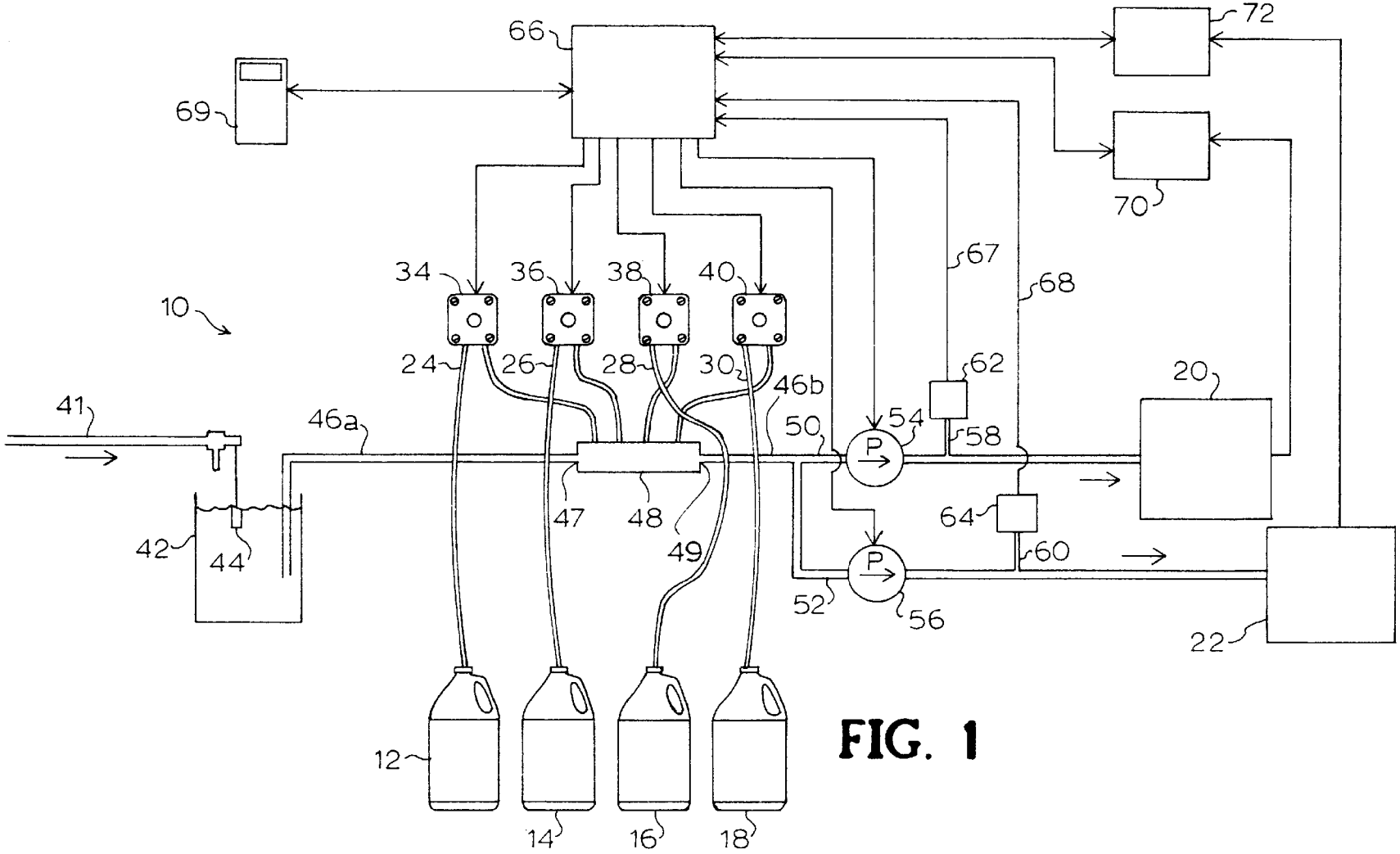
FIG. 1 is a block diagram of a chemical delivery system in accordance with the present invention.

FIG. 1 illustrates a chemical delivery system 10 in accordance with the present invention. The chemical delivery system 10 uses a programmable computer system to monitor and control the delivery of chemicals from containers 12, 14, 16, and 18 and water from water reservoir 42 to a plurality of washers 20, 22. The chemical delivery system 10 of the invention is primarily directed to the use of pressure sensors 62, 64 located along each washer input line 50, 52, to sense the fluid pressure in these lines. The pressure sensors generate output voltage signals directly proportional to variations of pressure within the washer input lines 50, 52 and transmit these signals to a main control board (MCB) 615 forming part of the computer system of the invention. From these pressure sensor output signals, the computer system of the invention as later more fully explained, determines if particular chemicals and water are being delivered according to pre-programmed formulas, and if not cause corrective actions to be taken as described in more detail below.

The description of the chemical delivery system 10 shall hereafter refer, by way of example, to delivery of chemicals to a pair of washers 20, 22. However, it is to be understood that the system of the present invention may be readily adapted to deliver chemicals from a plurality of chemical containers to more than two washers.

Referring to FIG. 1, flexible tubes 24, 26, 28, and 30 extend from the upper end of probes (not shown) mounted in the respective containers 12, 14, 16 and 18 and are in communication with pump means, provided by peristaltic pumps 34, 36, 38, and 40, respectively, and manifold 48. The probes are adapted to withdraw all of the liquid from containers 12, 14, 16, and 18 for delivery to washers 20, 22. The probes, containers, and container support system in a form suited to the present invention are disclosed in U.S. Pat. No. 5,628,430, which is hereby incorporated by reference.

Water reservoir 42 includes float valve 44 and receives input end of water line 415*a*. The level of water in water reservoir 42 is detected by float valve 44, which causes reservoir 42 to automatically refill through supply line 41 when water level falls below a predefined level. Water line 46*a* is connected to input end 47 of manifold 48. Output end 49 of manifold 48 is connected to output line 46*b*, which branches into washer input lines 50, 52, which deliver fluid from manifold 48 to machines 20, 22, respectively. Positive displacement pumps 54, 56 (hereinafter referred to as "transfer pumps") are located along machine input lines 50, 52, respectively. Between transfer pumps 54, 56 and washers 20, 22, sensor control input lines 58, 60 branch from machine input lines 50, 52 to pressure sensors 62, 64, of the type manufactured by MOTOROLA (MPX5100GP Series, MOTOROLA Application Note AN1305).

During normal operation, water is drawn from reservoir 42 through line 46*a* into input end 47 of manifold 48 by positive displacement transfer pump 54 or 56. Flexible tubes 24, 26, 28, and 30 transfer chemicals from containers 12, 14, 16 and 18 to dilute with the water flowing through manifold 48 by operation of peristaltic pumps 34, 36, 38, and 40 only one of which can run at any one time. Once delivered to manifold 48, each chemical is mixed with the water and delivered to output end 49 of manifold 48 into line 46*b* and then into either input line 50 or 52 by operation of either transport pump 54 or 56, depending on which washer 20 or 22 has been selected for liquid input.

Figure 2:
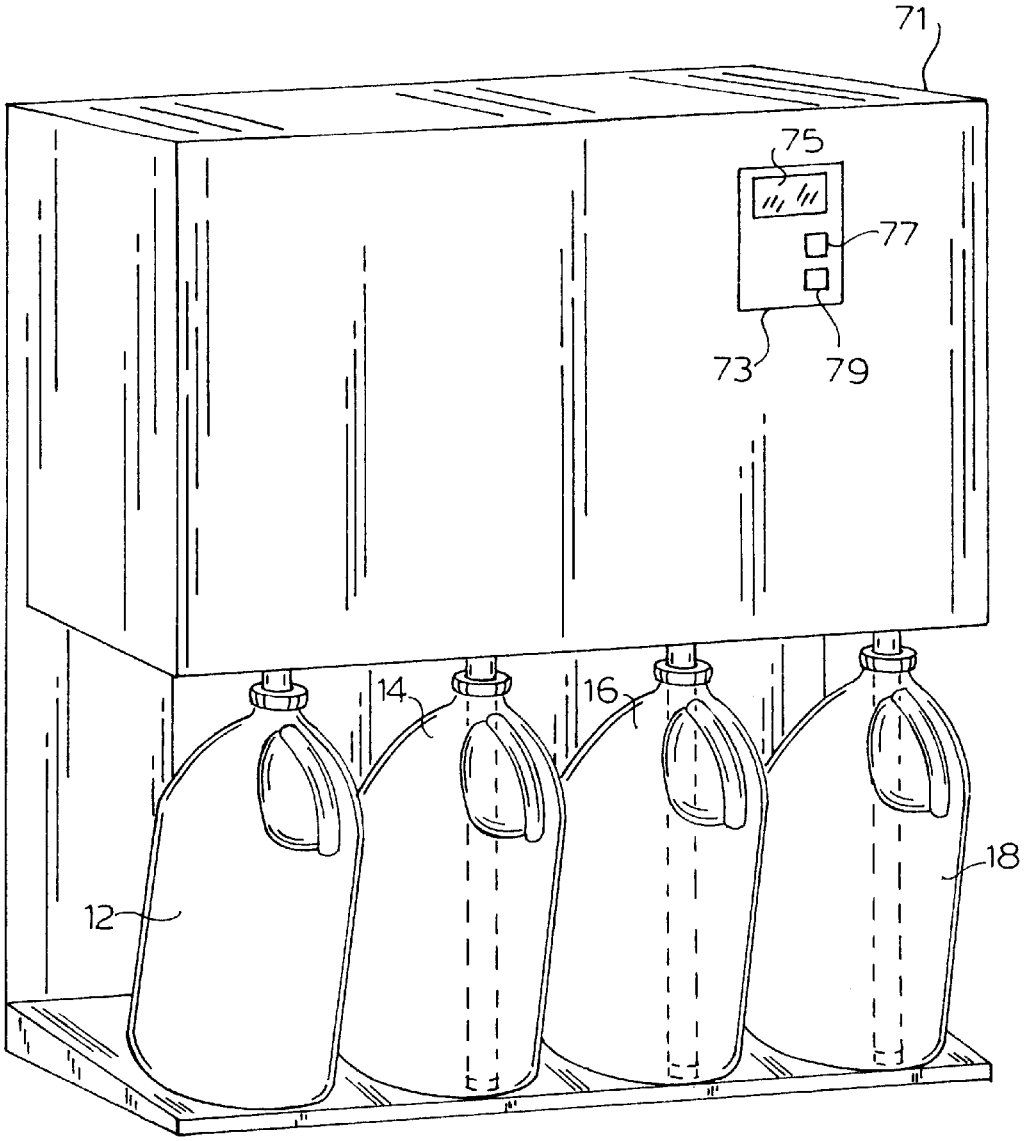
FIG. 2 is a perspective view of a box enclosure and containers support used in the system of the invention.

A number of the components of the invention are enclosed in a steel box of housing 71, illustrated in FIG. 2, which is typically secured to a vertical wall and includes a container shelf as further disclosed in the previously referred to U.S. Pat. No. 5,628,430.

Referring again to FIG. 1, the chemical delivery system 10 of the present invention contains only one sensor in each output line 50, 52 for sensing a change of pressure downstream of transfer pumps 54, 56, respectively. The distribution system of the invention is defined as lines 24, 26, 28, 30, 46*a*, 46*b*, 50, 52, 58, 60, interconnecting containers 12, 14, 16, and 18, manifold 48, reservoir 42, and washers 20, 22. A decrease or increase of pressure in the washer input lines between transfer pumps 54, 56 and washers 20, 22 translates into the same decrease or increase of pressure being detected by pressure sensors 60, 62. The pressure sensor of the type used in this invention utilizes a silicon piezo resistor, which generates a changing output voltage with variations in applied pressure. The pressure sensors include a strain gauge, such that a pressure on the device's diaphragm results in a resistance change in the strain gauge, which in turn causes a change in the output voltage in direct proportion to the applied pressure. Output voltage signals of pressure sensors 62, 64 are transmitted to main control board (MCB) 66 along lines 67, 68, respectively. The main control board (MCB) 66 will typically be powered by either a 120 VAC or 220 VAC, 60 Hz supply.

During operation, if a container 12, 14, 16, or 18, or water reservoir 42, is depleted of its chemical or water, air bubbles are introduced into a corresponding line 24, 26, 28, 30, or 46*a*, respectively, and then into water flowing through manifold 48. The air bubbles flow into washer input line 50 or 52, depending on which transfer pump 54, 56 is operating and reach either the respective transfer pump 54 or 56. Air bubbles flowing through the transfer pump 54 or 56 cause the transfer pump to cavitate. Cavitation of transfer pump 54 or 56 causes a decrease in fluid flow, thereby decreasing liquid pressure at pressure sensor 62 or 64. The decrease in pressure is detected by pressure sensor 62 or 64, which transmits low pressure signals to MCB 66 of the invention, where the data are analyzed and responded to as described in more detail below.

Referring still to FIG. 1, the chemical delivery system 10 monitors the status of and controls chemical and water delivery by employing the previously mentioned and programmable MCB 66. MCB 66 contains a microprocessor of the type manufactured by MOTOROLA (Item No. MC68HC11A1), and has input output ports communicating with an external programmer terminal 69 such as Model ST/2000 of the type manufactured by WPI TERMIFLEX, INC. of Merrimack, N.H., washer interface modules (WIMs) 70,72 connected to washers 20, 22, peristaltic pumps, 34, 36, 38, and 40, transfer pumps 54, 56, and pressure sensors 62, 64. MCB 66 is also connected to input membrane switches 77, 79 and a seven segment, three character output display 75, which are mounted to the front surface of box or housing 71, all of which are only schematically illustrated in FIG. 2.

Upon installation of the chemical delivery system, and upon subsequent system maintenance and update, the external programmer 69 is connected to the MCB 66 to conduct a series of tasks, including administration of a self-test, calibration of the transfer pumps, pressure sensors, chemical dispensing pumps, and setting the volumes of chemicals for each formula. Calibration and programming of a computer such as MCB 66 so that the chemical delivery system of the invention deliver chemicals corresponding to selected formulas is well known in the art and will not be discussed in detail. Generally, once the external programmer 69 is attached and ready, a master menu screen is displayed allowing the user to enter the programming state. The operator calibrates the transfer pump time, the normal operating pressure, and the flow rate for each transfer pump. The installer can then program the desired quantity of each chemical for each formula. The operator calibrates the pressure sensors by starting the appropriate transfer pump. For example, the operator starts transfer pump 54 to calibrate pressure sensor 62. After two seconds, the MCB 66 records the "inormal" pressure sensed by pressure sensor 62. The calibration process described for pressure sensor 62 is repeated for pressure sensor 64. MCB 66 then sets a "normal" pressure range for each pressure sensor. MCB 66 detects low and high pressure in washer input lines 50, 52 downstream of transfer pumps 54, 56, by comparing pressure sensor input signals with the pre-programmed "normal" pressure range. Calibration of the peristaltic pumps is similarly accomplished in the manner as is generally known in the art to determine the volume each will deliver.

Rather than pre-program a "normal" pressure range for comparison with the sensor input signals, it is also within the scope of the present invention to use algorithms to periodically look for a change in pressure. In general, the algorithms mathematically filter out undesirable events. In this application, an algorithm may be used to eliminate the requirement that a "normal" pressure be manually set. The algorithm can be written to recognized a rate of change over a period of time. This enables the system to ignore transient events, large spikes, and other undesirable events.

MCB 66 has stored in non-volatile (EEPROM) memory the pre-programmed formulas for delivery of appropriate chemicals to the washers 20, 22. A formula is defined as a chemical sequence of up to four chemicals, and the dispensing time(s) for each. In the preferred embodiment, MCB 66 can accept up to eight chemical formulas for each machine 20, 22 for a total of sixteen formulas. MCB 66 contains one default pre-programmed formula.

MCB 66 also includes a three character, seven segment display 75. During normal operation, identified as the "alive" state, the three center bars of each character display continuously scroll. During trouble MCB 66 causes the display to read "Err" and an alarm to sound. In the event the microprocessor fails, the display shall stop scrolling. "LP1" identifies low pressure in line 50 downsteam of pump 54. "LP2" identifies low pressure in line 52 downstream of pump 56. "HP1" identifies high pressure in line 52 downstream of pump 54. "EHP2" identifies high pressure in line 52 downstream of pump 56. The three character LCD displays "LC" followed by the number 1, 2, 3 or 4 (the symbol "#" hereinafter refers to the number that follows "LP" or "BHP") when a chemical is not being dispensed from containers 12, 14, 16, or 18 into manifold 48 as expected.

WIMs 70, 72 provide the primary operator interface for chemical requests from washers 20, 22. The interface between WIMs 70, 72 and the chemical requests from washers 20, 22 must include optoisolators (not shown) to protect the dispenser unit and washer circuits from noisy industrial signals typical of washers 20, 22. WIMs 70, 72 use a microprocessor of the type manufactured by MOTOROLA (No. MC68HC705P9). Each WIM 70, 72 microprocessor includes input and output data ports communicating with MCB 66, a data clock, and is connected to a seven segment three character display, three membrane switches, a trouble LED, and an alive LED (not shown). The seven segment display displays washer number, currently selected formula, and the formula load count (number of wash cycles corresponding to the particular washer).

The WIMs 70, 72 send a series of chemical request signals corresponding to a particular pre-programmed formula to MCB 66. The chemical request signals are queued by MCB 66. Typically, two of the containers 12, 14, 16, and 18 contain chemicals that should not be mixed together. Therefore, any time one of these two chemicals (that should not be mixed together) are requested, MCB 66 shall ignore any request for the second chemical for up to five minutes after the first chemical is requested by the same washer.

An operator selects a formula by pressing membrane switch located on the front of WIMs 70, 72 to change the displayed formula to the next numerical formula sequentially either up or down. For example, WIMs 70, 72 may be displaying "F2," indicating that products or chemicals programmed for the formula 2 is selected in response to signals from washers 20, 22. If the operator puts in a new load of goods into each washer 20, 22 that need to be run on formula 4, the operator would press the formula up button twice, changing the display to "F4." The display rolls over from F8 to F1 and the other way.

In general, upon receiving a valid chemical request signal, MCB 66 shall cause appropriate transfer pump 54, 56 to start a three second pre-flush procedure. After the preflush, MCB 66 activates one of peristaltic pumps 34, 36, 38, or 40 for delivery of the appropriate chemical to manifold 48. The selected peristaltic pump 34, 36, 38, or 40 run for a pre-programmed time to deliver the appropriate amount of chemical to manifold 48 and then stops. Once peristaltic pump 34, 36, 38, or 40 stops, the selected transfer pump 54 or 56 continues for a post-flush of from 5 seconds up to 2 minutes, as necessary and preset by using the terminal 69.

Figure 3:
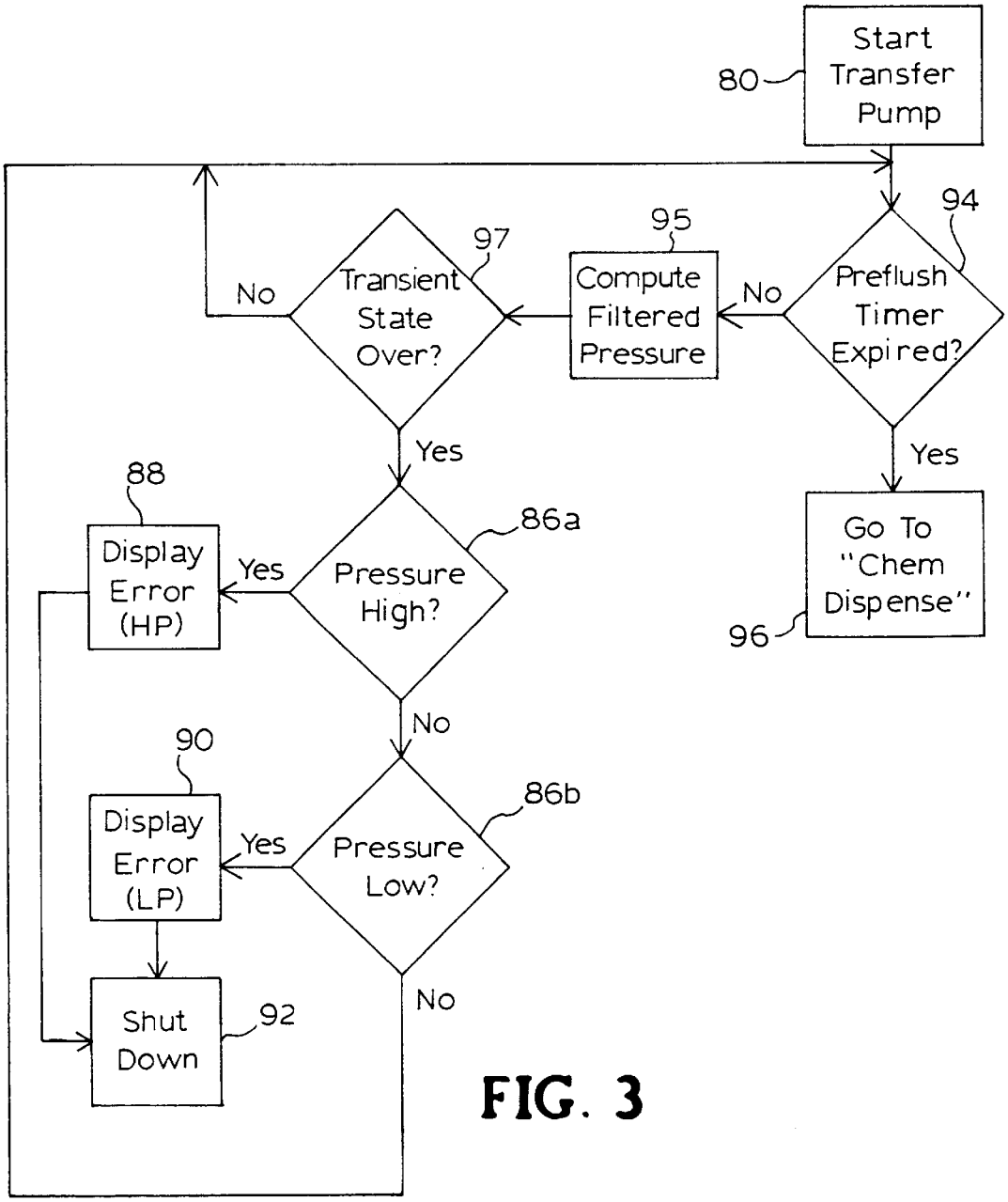
FIG. 3 is a flow chart showing the preflush process prior to delivery of a particular chemical to a washer.

Normal operating sequence of the chemical delivery system 10 of the invention starts with the operator initiating a particular wash cycle by pressing the formula select switch, repeatedly if needed, until the desired formula code is displayed on the WIM seven segment display. The WIM will receive and process the chemical requests from the washer. A chemical request will be ignored if there isn't a value for it programmed into the selected formula. FIG. 3 illustrates the preflush process prior to delivery of a particular chemical to washer 20, 22. If there is a programmed value, MCB 66 will start the appropriate transfer pump for the three second pre-flush of step 80. After two seconds, before the preflush time has expired at step 94, MCB 66 will compute filtered pressure at step 95. Computing filtered pressure essentially refers to signal conditioning. The electronics in the pressure sensor and MCB 66 dampen wild swings in pressure. MCB 66 then determines if the transient state is over at step 97. The transient state refers to brief swings in pressure that occur when a pump first starts or stops. Once the transient state is over, MCB 66 checks for high or low pressure at steps 86*a*, 86*b*. If the pressure is high or low, then MCB 66 shall stop the sequence at step 92, activate the alarm, and declare a system error at steps 88, 90 by displaying "Err" on seven segment display 75. The operator may then scroll through display messages using membrane switch 77 to identify the error as LP1, LP2, HP1, or HP2, depending on which transfer pump is activated. If no system error is indicated and the preflush time at step 94 has expired, MCB 66 shall start appropriate peristaltic pump 34, 36, 38, or 40 to dispense chemical at step 96.

Figure 4A:
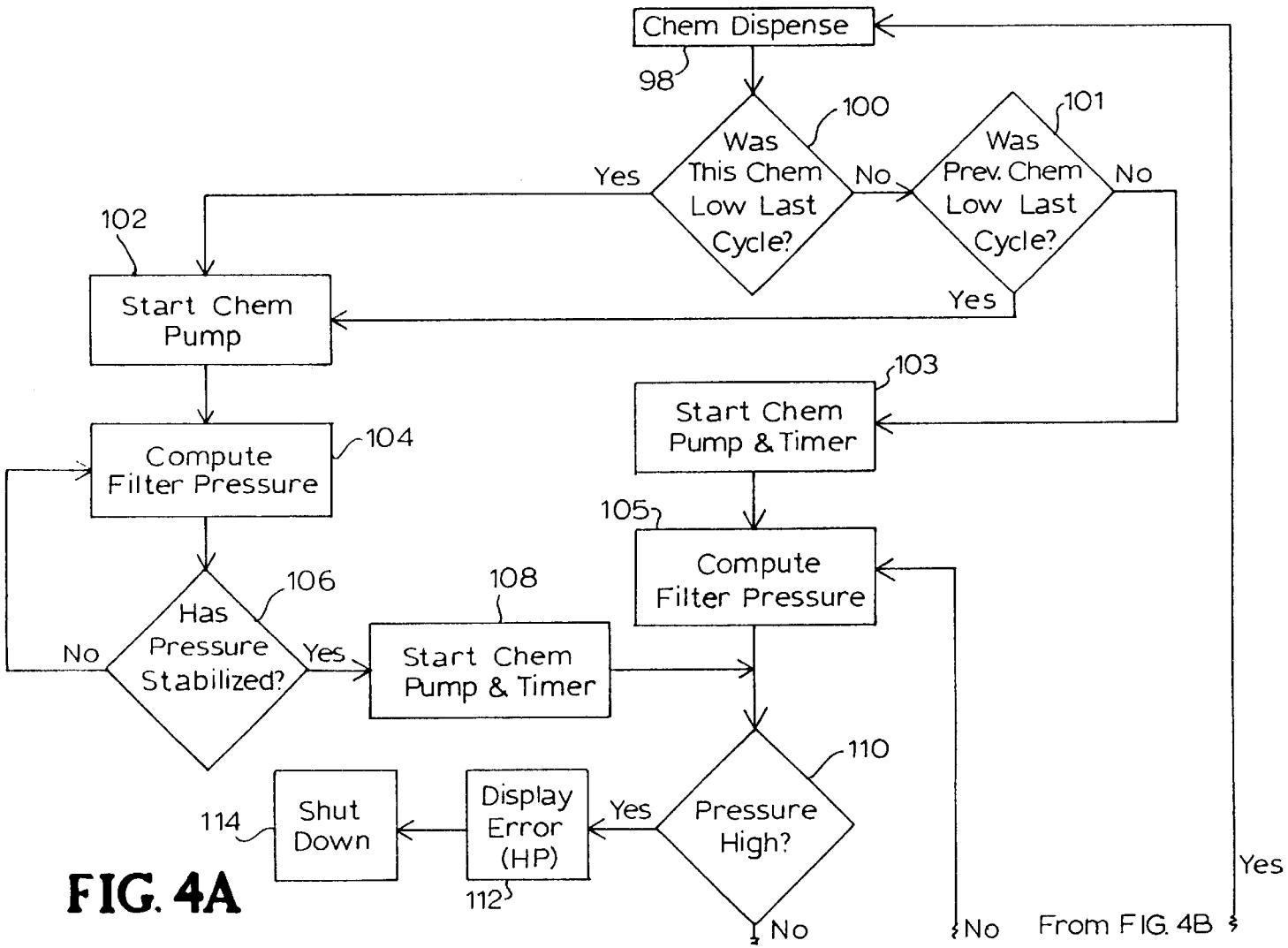
FIGS. 4A and 4B constitute a flow chart showing the process for dispensing an appropriate amount of chemical to a washer.
Figure 4B:
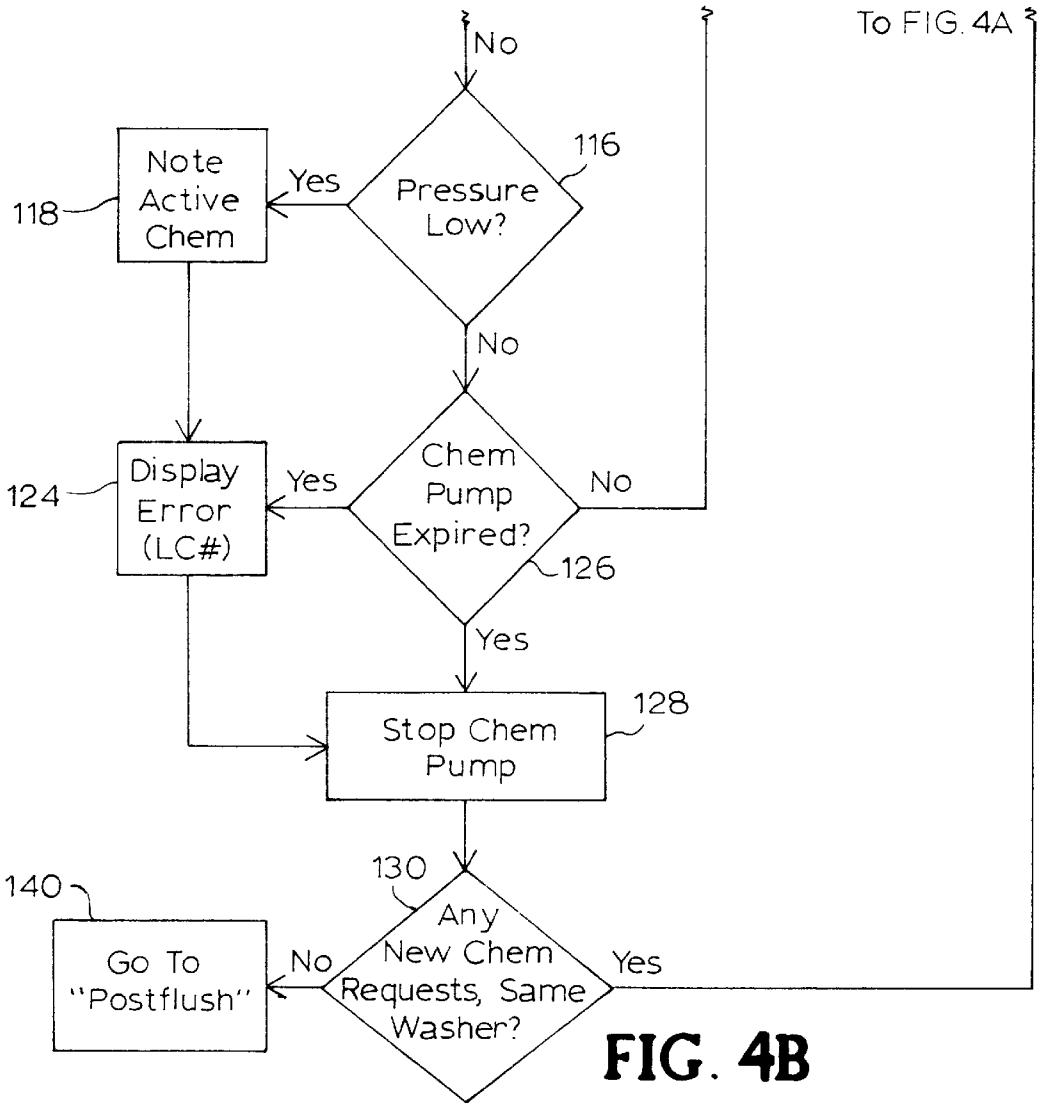

Referring now to FIG. 4*a* there is illustrated a flow chart showing the process of dispensing an appropriate amount of chemical to a washer. Once the preflush time has expired and the system did not detect an error, the system checks to see if the chemical was low during the last cycle at step 100. If yes, MCB 66 starts the selected chemical pump at step 102 and then computes the filter pressure at step 104. When the pressure has stabilized, then MCB 66 starts the chemical pump and chemical timer at step 108. If the pressure has not stabilized, the system computers the filter pressure at step 104, until it does. In other words, if the chemical being requested was low the previous cycle, the system waits until the pressure has come back to normal value before starting the chemical timer. This primes the chemical pump, thus delivering washers 20, 22 the correct quantity of selected chemical. If this chemical was not low last cycle as in step 100, but the previous chemical dispensed, without an intermediate post-flush, was low as in step 101, the same procedure described above starting at step 102 is used to flush out any air before starting another chemical injection. However, if both step 100 and step 101 are answered "No", MCB 66 starts the chemical pump and timer at step 103. If MCB 66 detects that the pressure corresponds to the normal operating pressure as detected by steps 116, 126, of FIG. 4*b* and the chemical pump time has expired at step 126, the pump stops at step 128 and asks if there are any new chemical requests at step 130. If there is another chemical request in the queue for the same washer, the system initiates chemical dispense process at step 98 as illustrated in FIG. 4A. If there is not a subsequent chemical request in the queue, then the next step in the chemical delivery process is the postflush of step 140 (FIG. 4B). If the pressure is not normal and the system shows high pressure at step 110 (indicating blockage in the line between pressure sensors 62, 64 and washers 20, 22), then the system displays an error at step 112 and shuts the system down at step 114. If pressure sensor 62 or 64 detects low pressure at step 116, then the MCB 66 notes which chemical is being dispensed at step 118, displays the LC# (where "#" indicates the particular chemical container being dispensed from), sounds the alarm and shuts down the system.

Figure 5:
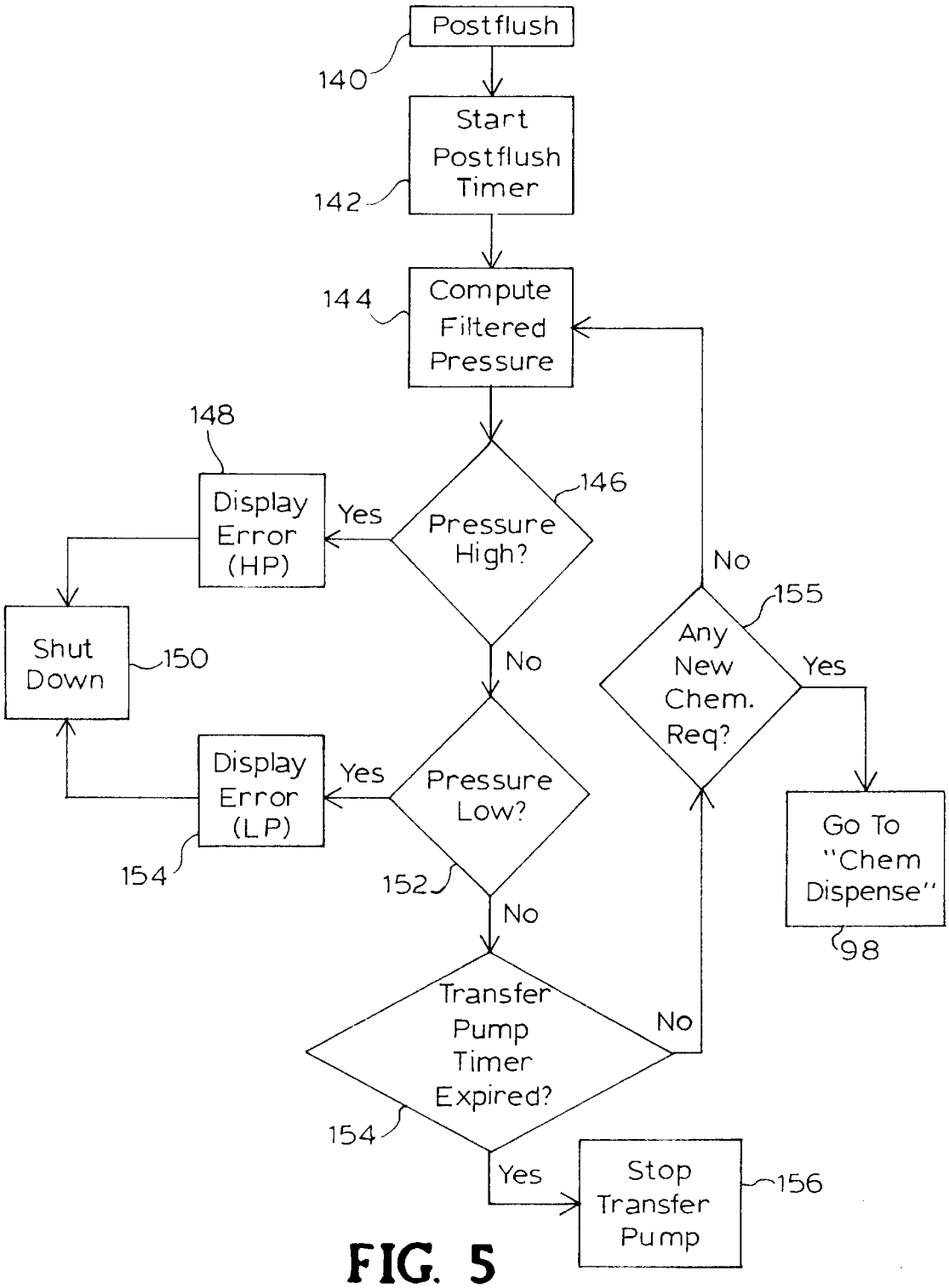
FIG. 5 is a flow chart showing the postflush process after delivery of a chemical to a washer.

Referring to FIG. 5, there is shown a flow chart of the delivery system postflush process at step 140. Upon delivery of chemical as illustrated in FIG. 4, MCB 66 starts the postflush timer at step 142 and computes filtered pressure at step 144. If pressure is high, then the error HP# is displayed at step 148 and the system is shut down at step 150. If pressure sensor 62 or 64 detects low pressure, indicating that water level in reservoir 42 may be low, then the error LP# is displayed at step 154 and the system is shut down at step 150. If pressure sensors indicated normal operating pressure, the MCB checks if the transfer pump timer has expired at step 154. If not, then the MCB program decides whether a new chemical request has been received at step 155. If not, MCB 66 again determines the computers filtered pressure at step 144. If the MCB has received a chemical request, the MCB initiates the chemical request at step 98, as illustrated in FIG. 4*a*. Under normal pressure operating conditions, when the transfer pump timer has expired, the MCB stops the transfer pump at step 156.

It is understood to be within the scope of the present invention to use pressure sensors along a distribution system for dry chemical systems known in the art. The present invention may also be used for other chemical delivery systems. For example, the present invention may be useful in manufacture of industrial chemicals, delivery of medicines or other chemicals in clinical medicine and related research, and possibly for delivery of mixed liquid products, such as drinks, in the retail industry.

While the invention has been described with reference to specific embodiments thereof, it will be appreciated that numerous variations, modifications, and embodiments are possible, and accordingly, all such variations, modifications, and embodiments are to the regarded as being within the spirit and scope of the invention.

What is claimed is:

1. A system for controlling delivery of water and a plurality of chemical products to a washer comprising:

a) distribution means for distributing a plurality of chemical products to a specified washer having man input line;

b) a water supply reservoir coupled through a water line to an input end of said distribution means;

c) a plurality of chemical holding containers, coupled to said distribution means through separate corresponding pump means, whereby a chemical product is selectively drawn from such containers by said corresponding pump means into said distribution means, said pump means outputs are coupled to said distribution means downstream of said input end of said distribution means;

d) displacement pumping means for pumping said chemicals and water through said distribution means to said specified washer;

e) mixing means coupled to said distribution means for mixing said chemicals with the water from said reservoir;

i) a fluid pressure sensor coupled to said distribution means downstream of said mixing means;

g) controller means for controlling delivery of water and chemical products, said controller means coupled to said fluid pressure sensor for monitoring and detecting pressure in said distribution means, whereby a high or low pressure level acts as an interrupt signal whenever a corresponding chemical product or water is needed for said specified washer.

2. The apparatus of claim 1 comprising:

a) a second specified machine washer having an input line, and wherein said displacement pumping means comprises at least a first and second transfer pump, said reset and second transfer pumps are both coupled to said distribution means, said first transfer pump is operable to draw water from said reservoir into said input end of said distribution means and transfer water and diluted chemical product fluids therefrom through said distribution means into said input line for said specified washer; said second transfer pump is operable to draw water from said reservoir into said input end of said distribution means and transfer water and diluted chemical product fluids therefrom through said distribution means into said input line for said second specified washer; and b) a first fluid pressure sensor, wherein said first fluid pressure sensor is coupled to said output end of said first transfer pump to monitor and detect a high or low pressure downstream of said first transfer pump into said input line for said specified washer, whereby a high or low pressure level acts as an interrupt signal whenever a corresponding chemical product or water is needed for said specified washer; said second fluid pressure sensor is coupled to an output end for said second transfer pump to monitor and detect a high or low pressure downstream of said second transfer pump into an input line for said second specified washer, whereby a high or low pressure level acts as an interrupt signal whenever a corresponding chemical product or water is needed for said second specified washer.

3. The apparatus of claim 1 further comprising a box for enclosing said distribution means, said reservoir, displacements pumping means, and said controller means.

* * * * *

UNITED STATES PATENT AND TRADEMARK OFFICE

CERTIFICATE OF CORRECTION

PATENT NO. : 6,055,831

DATED : May 2, 2000

INVENTOR(S) : David J. Barbe

It is certified that error appears in the above-identified patent and that said Letters Patent are hereby corrected as shown below:

Column 1, line 51, after "product", delete --.-- (period).

Column 3, line 9, after "(MCB)", delete "615" and insert --66--.

Column 3, line 34, change "line 415a" to read --line 46a--.

Column 3, line 62, change "box of housing" to read --box or housing--.
Amendment of 8/12/98).

Column 5, line 42, change "EHP2" to read --HP2--.

Column 5, line 46, change "BHP" to read --HP--.

Column 8, line 5, change "man" to read --an--.

Signed and Sealed this

First Day of May, 2001

*Attest:*

Nicholas P. Godici

NICHOLAS P. GODICI

*Attesting Officer*

*Acting Director of the United States Patent and Trademark Office*